US008640896B2

(12) United States Patent
Martin

(10) Patent No.: US 8,640,896 B2
(45) Date of Patent: Feb. 4, 2014

(54) ANGLE ADJUSTMENT OF A JIB SYSTEM

(75) Inventor: Michael Martin, Illingen (DE)

(73) Assignee: Terex Cranes Germany GmbH, Zweibruecken (DE)

( * ) Notice: Subject to any disclaimer, the term of this patent is extended or adjusted under 35 U.S.C. 154(b) by 709 days.

(21) Appl. No.: 12/785,967

(22) Filed: May 24, 2010

(65) Prior Publication Data

US 2010/0294738 A1 Nov. 25, 2010

(30) Foreign Application Priority Data

May 22, 2009 (DE) ..... 10 2009 022 262

(51) Int. Cl.
*B66C 23/68* (2006.01)

(52) U.S. Cl.
USPC ..... 212/300; 212/168; 212/299

(58) Field of Classification Search
USPC ..... 212/175, 176, 177, 299, 300, 168, 292; 403/348, 349, 353
See application file for complete search history.

(56) References Cited

U.S. PATENT DOCUMENTS

| | | | | |
|---|---|---|---|---|
| 2,031,549 | A * | 2/1936 | Ruff | 212/293 |
| 3,085,695 | A * | 4/1963 | Miller | 212/300 |
| 3,749,438 | A * | 7/1973 | Loomis et al. | 294/81.53 |
| 4,024,957 | A * | 5/1977 | Schleis | 212/300 |
| 4,653,655 | A * | 3/1987 | Rathi et al. | 212/300 |
| 5,082,128 | A * | 1/1992 | Franzen et al. | 212/347 |
| 5,199,586 | A * | 4/1993 | Pech et al. | 212/175 |
| 5,842,587 | A * | 12/1998 | Wanek et al. | 212/177 |
| 2009/0139948 | A1 * | 6/2009 | Holly et al. | 212/292 |

FOREIGN PATENT DOCUMENTS

| | | | |
|---|---|---|---|
| DE | 2318314 | C2 | 11/1973 |
| DE | 3642248 | C2 | 6/1987 |
| DE | 202007012204 | U1 * | 12/2007 |
| EP | 1477451 | B1 | 11/2004 |
| WO | 83/03816 | | 11/1983 |
| WO | 02/076874 | | 10/2002 |
| WO | 2009026870 | A1 | 3/2009 |

* cited by examiner

*Primary Examiner* — William E Dondero
*Assistant Examiner* — Nathaniel Adams
(74) *Attorney, Agent, or Firm* — Browdy and Neimark, PLLC

(57) ABSTRACT

Method for adjusting the angle of a jib system of a crane, comprising the steps of providing two jib units of the jib system, which can be variably arranged with respect to their longitudinal axes in an angle position in relation to one another, arranging connecting links attached to the jib units in such a way that the longitudinal axes of the jib units are parallel in a starting angle position, starting openings and target openings of the connecting links are aligned with one another pairwise to insert a connecting element connecting the jib units, the aligned starting openings being connected with the connecting element, relieving the connecting element connecting the aligned starting openings, removing the first connecting element, connecting a pair of the aligned target openings with the connecting element, and arranging the jib units in a target angle position which is different from the starting angle position.

6 Claims, 6 Drawing Sheets

ANGLE ADJUSTMENT OF A JIB SYSTEM

FIELD OF THE INVENTION

The invention relates to a method and a device for adjusting the angle of a jib system of cranes, as well as to a crane with a device of this type.

BACKGROUND OF THE INVENTION

It is known from public prior use that a crane has a jib system, on which an extension and/or an angled arrangement can be provided. EP 1 477 451 A2, DE 36 42 248 A1 and WO 2009/026 870 A1 disclose devices, by means of which an angle position of a jib system can be changed. The drawback is that the angle adjustment of the jib system often needs further aids and/or intermediate steps. A more rapid and easier to handle change of one angle position into another is not possible with the devices mentioned.

SUMMARY OF THE INVENTION

It is therefore the object of the invention to configure a method for adjusting the angle of a jib system of cranes in such a way that a change from a starting angle position into a plurality of angle positions which differ from this is possible, the change between the two angle positions being rapid to implement and easy to handle.

This object is achieved according to the invention by a method for adjusting the angle of a jib system of a crane, comprising the steps of providing two jib units of the jib system, which can be variably arranged with respect to their longitudinal axes in an angle position in relation to one another, arranging connecting links attached to the jib units in such a way that the longitudinal axes of the jib units are parallel in a starting angle position, starting openings and target openings of the connecting links are aligned with one another pairwise to insert a connecting element connecting the jib units, the aligned starting openings being connected with the connecting element, relieving the connecting element connecting the aligned starting openings, removing the first connecting element, connecting a pair of the aligned target openings with the connecting element, and arranging the jib units in a target angle position which is different from the starting angle position.

According to the invention it was recognised that two jib units connected to one another of a jib system can be transferred from a starting angle position into an angle position which differs therefrom by means of connecting links, in that the connecting links are arranged in the starting angle position in such a way that a plurality of openings of the connecting links are aligned pairwise to insert a connecting element connecting the jib units. The jib system is held in the starting angle position by the connecting element, which is arranged in a pair of aligned starting openings, wherein, to change into a target angle position, the connecting element is firstly relieved of its load, is then removed from the pair of aligned starting openings and is finally arranged in a further one of pairs of aligned target openings provided for this to connect them. Thus, proceeding from the starting angle position, a desired target angle position can be selected from a plurality of possible ones and adjusted, by simple operation in particular by one-handed operation.

Using a method, wherein jib units are arranged in one of two possible target angle positions, in particular in a 20° position or in a 40° position, by connecting a pair of the aligned target openings, particularly preferred angle positions can be adjusted rapidly and directly.

The angle adjustment using a method, wherein the angle of the jib units is adjusted by pivoting about a common pivoting unit, allows a simple relative movement between the two jib units.

Using a method, wherein it is possible to change the connecting element by hands, an angle adjustment of the jib units is possible without further aids.

A connecting element is relieved in a particularly simple manner by a method, wherein the relieving of the connecting element takes place by lifting or supporting the jib unit to be angled.

Moreover, previously known angle-adjustable jib systems were generally constructed in a complex manner and therefore require a large installation space, in particular in the starting angle position of the jib systems. As a result, the overall length of a crane, on which the jib system is mounted, may exceed a permissible overall length, so that street transportation of the crane is no longer possible.

A further object of the invention is to configure a device for adjusting the angle of a jib system of cranes in such a way that a change from a starting angle position to a target angle position is made possible, rapidly, economically and while maintaining the stability of the jib system, the jib system, in particular in the starting angle position, having an overall size such that the street transportation of a crane with the mounted jib system is possible.

This object is achieved according to the invention by an angle-adjustable jib system, wherein, in the starting angle position, the longitudinal axes of the jib units are parallel, the openings of the two legs are aligned with one another pairwise to insert a connecting element connecting the jib units and the starting openings are connected with the connecting element.

It was recognised according to the invention that a jib unit has a connecting link with a plurality of openings, the connecting links of the jib units being arranged in the starting angle position in such a way that the longitudinal axes of the jib units are arranged in parallel and a plurality if openings are aligned with one another pairwise to insert a connecting element connecting the jib units. In this arrangement, the two jib units form an aligned jib system. Each connecting link has two legs, which are arranged at an angle to one another, the first leg having a starting opening to connect the connecting links with the connecting element in the starting angle position and the second leg having a plurality of target openings for connecting the connecting links with the connecting element in various target angle positions.

A jib system, wherein the second leg has two target openings, makes the selection of two different target angle positions possible.

Owing to designs of the jib system, wherein a spacing of the starting opening from the vertex opening is smaller than spacings of the target openings from the vertex openings, two particularly preferred angle positions can be adjusted rapidly and easily. A spacing of the starting opening from the vertex opening and spacings of the target openings from the vertex opening may be fixed in such a way that the longitudinal axes can be arranged in relation to one another in various target angle positions, in particular in a 20° angle position or in a 40° angle position by connecting the corresponding target openings, by means of the connecting element.

A configuration of the jib system, wherein the angle arrangement of the legs in relation to one another is variable, allows additional target angle positions without further connecting links having to be used. This may be achieved, for example, in that the legs have further target openings, which, with a varied angle arrangement of the legs, are aligned in such a way that further target angle positions of the jib units can be adjusted. Further target angle positions may, for example, be greater than 20°, adopt an angle size of between 20° and 40° or be greater than 40°.

The use of connecting links having a plurality of plates, which are arranged parallel to one another and spaced apart in the direction of the connecting element, allows the production and therefore also the cost outlay for the connecting links to be reduced. The first connecting link may have one plate more than the second connecting link, it being possible to arrange the connecting links offset with respect to one another in such a way that the plates of the second connecting link are arranged between the plates of the first connecting link.

Jib systems, wherein at least one jib unit is a lattice boom, and wherein one jib unit is a telescopic jib head, may be used as an extension for a lattice mast or for attaching a telescopic jib head to a lattice boom.

A jib system, wherein an extension parallel to the longitudinal aces in the starting angle position is smaller than a permissible maximum value, in the starting angle position, has a small overall size, in particular in the direction of the longitudinal axes of the jib units. A crane, on which the jib system is mounted, may have a permissible overall length and is therefore permitted for street traffic.

In a jib system, wherein at least one connecting link has a stop for resting in the starting angle position on a fork head of the respective jib unit arranged opposing, in the starting angle position, a pivoting movement of the jib units in relation to one another counter to an intended pivoting direction is prevented.

In a crane with a jib system according to the invention, an angle adjustment of a jib system is simple, rapid and therefore economical.

An embodiment of the invention will be described in more detail below with the aid of the drawings.

DESCRIPTION OF THE PREFERRED EMBODIMENT

Figure 1:
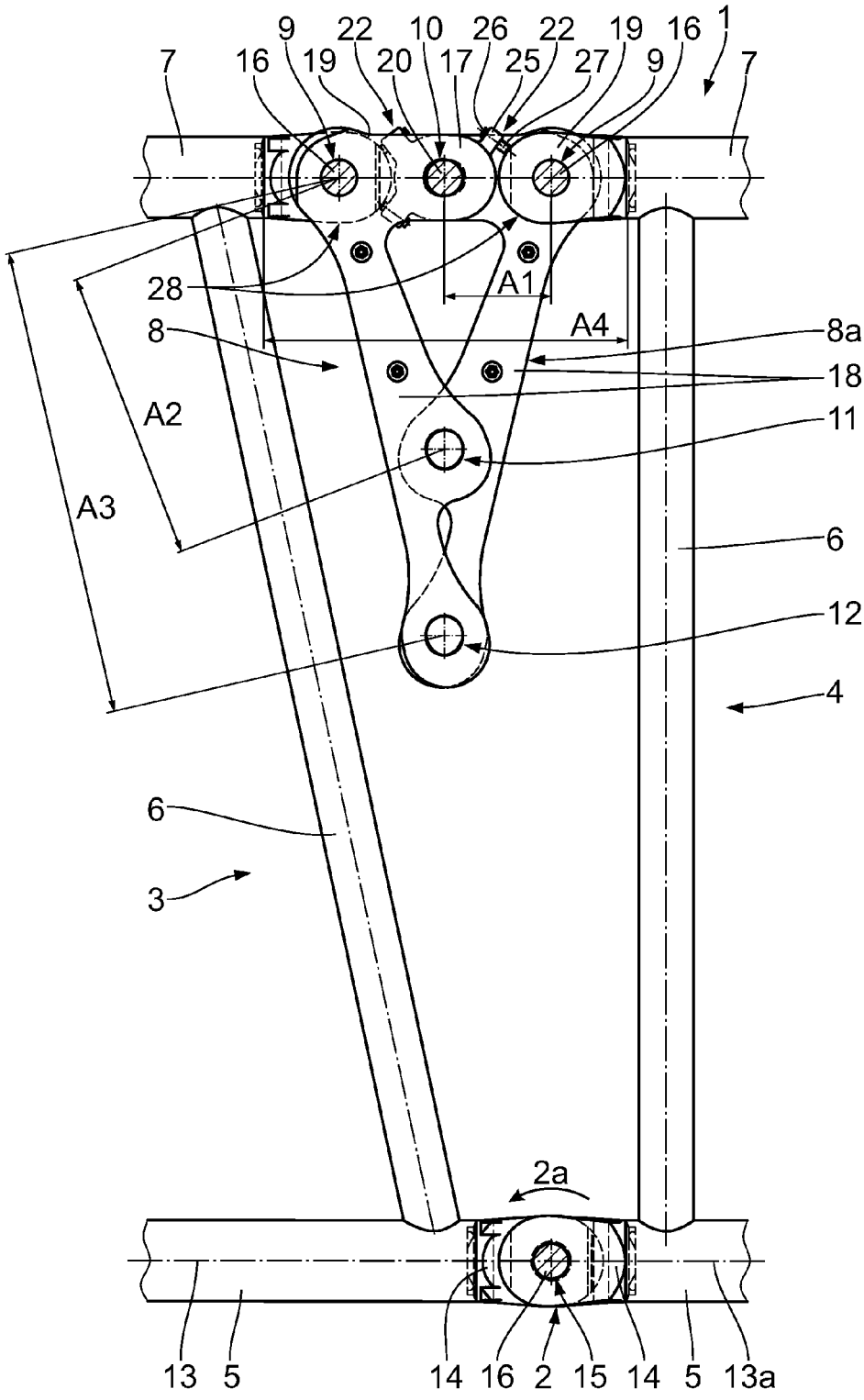
FIG. 1 shows a side view of a first embodiment of a jib system in a starting angle position.

A jib system 1 shown in FIG. 1 has two jib units 3, 4 connected to one another by a pivoting unit 2, the two jib units 3, 4 being a lattice boom. It is also possible for a jib unit to be configured as a telescopic jib head.

Each jib unit 3, 4 has a lower band 5, an upper band 7 connected to the lower band 5 by at least one strut 6, a connecting link 8, 8*a* attached to the upper band 7 with a plurality of openings 9 to 12 and a longitudinal axis 13, 13*a*. In the starting angle position shown of the jib system 1, the two longitudinal axes 13, 13*a* of the jib units 3, 4 are parallel.

The lower band 5 comprises a pivoting plate 14 with a pivoting opening 15, the jib units 3, 4 being arranged in such a way that the pivoting openings 15 are aligned with one another and are connected to one another by a bolt 16. The pivoting plates 14 connected to one another by the bolt 16 to form the pivoting unit 2, which is in each case attached to the lower band 5 of the two jib units 3, 4 and allows a pivoting movement of the two jib units 3, 4 in a pivoting direction 2*a*.

Each connecting link 8, 8*a* has two legs 17, 18, which are arranged at an angle, in particular smaller than 90°, in relation to one another. The opening provided at a vertex 19 of the connecting link 8, 8*a* is called a vertex opening 9 and is used for a pivotable connection of the connecting link 8, 8*a* to the upper band 7 by a bolt 16. The opening 10 of the first leg 17 is called a starting opening and the openings 11, 12 of the second leg 18 are called target openings.

In the starting angle position, the connecting links 8, 8*a* are arranged in such a way that both the starting openings 10 of the connecting links 8, 8*a* and also the target openings 11 and 12 of the connecting links 8, 8*a* are, in each case, aligned with one another pairwise. Furthermore, the connecting links 8, 8*a* are connected to one another by a connecting element 20 inserted in the starting openings 10 thereof arranged in an aligned manner. As the starting openings 10 as well as the target openings 11, 12 are configured as slots, the connecting element 20 inserted in a respective aligned opening pair 10, 11, 12 is moveable. For this purpose, the connecting element 20 has to be relieved. The relief process will be described in more detail below.

Furthermore, the connecting links 8, 8*a* in each case have, on the first leg 17, a stop 22, which comprises at least one lug 25 with a threaded bore 26 and a threaded pin 27 screwed therein. The stop 22, in the starting angle position, rests on a fork head 28 of the respective opposing upper band 7 of the respective jib unit 3, 4, so a pivoting movement of the jib units 3, 4 counter to the pivoting direction 2*a* is blocked in the starting angle position.

A central spacing A1 of the starting opening 10 from the vertex opening 9 is smaller than the central spacings A2, A3 of the target openings 11, 12 from the vertex opening 9. By means of a variation in the spacings A1, A2, A3, the resulting target angle positions can be adjusted.

In the starting angle position, the jib system 1 has a horizontal extent A4, which is determined by the overall size of the connecting links 8, 8*a*. In this case, the extent A4 is smaller than a permissible maximum value, so a crane with a jib system 1 mounted thereon does not exceed an overall length permissible for street transportation and therefore is permitted for street transportation.

A method for adjusting the angle of the jib system 1 will be described below. For this purpose, proceeding from the jib system 1 in the starting angle position according to FIG. 1, the connecting element 20 is relieved by lifting or supporting the jib unit 3 to be angled. The lifting may take place, for example, by means of an auxiliary crane not shown, forklift or another lifting machine. It is also possible to lift the jib unit 3 by a cable winch located on the crane. Moreover, the jib unit 3 may be supported on the ground by an end opposing the connecting link 8.

A pivoting movement of the jib unit 3 counter to the pivoting direction 2*a* is blocked by the stops 22. As the starting openings 10 are configured as slots, the connecting element 20, in the relieved state, can be removed, simply and by hand, from the aligned starting openings 10 of the connecting links 8, 8*a*. One of the pairs of aligned target openings 11 or 12 is then connected by the connecting element 20. The target angle position resulting from this is fixed by the selection of the pair of target openings 11 or 12 to be connected.

Once the pair of aligned target openings 11 or 12 has been connected to one another by the connecting element 20, the connecting element 20 is loaded again, in that the lifted or supported jib unit is let down again or released. Thus the connection of the connecting links 8, 8*a* at the starting openings 10 is opened, with the jib units 3, 4 pivoting about the pivoting unit 2 in the pivoting direction 2*a* until the two vertex openings 9 and the target openings 11, 12 connected with the connecting element 20 are arranged on a common straight line 23, 24 (see FIGS. 3 and 4).

Figure 2:
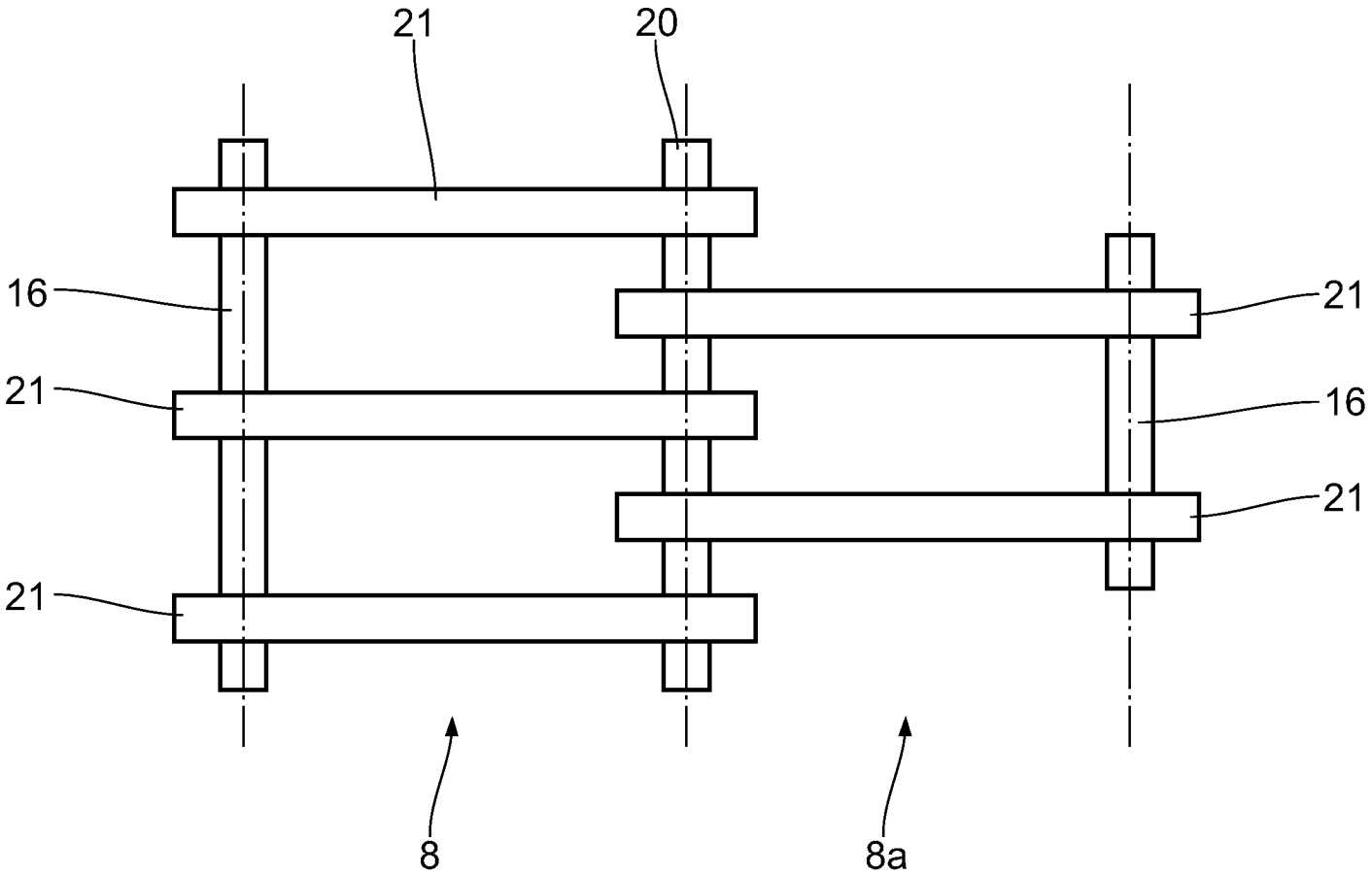
FIG. 2 shows a schematic view of a plan view of two connecting links, which are connected to one another, of the jib system according to FIG. 1.

As shown schematically in FIG. 2, the connecting link 8 has three plates 21 and the connecting link 8*a* has two plates 21. The plates 21 are arranged in parallel and spaced apart from one another in the direction of the first connecting element 20. In this case, the connecting links 8, 8*a* are arranged offset with respect to one another in such a way that the plates 21 of the connecting link 8*a* are arranged between the plates 21 of the connecting link 8. The geometry of the plates 21 is identical for the two connecting links 8, 8*a*, so the production outlay and therefore the production costs for the connecting links 8, 8*a* are reduced. The connecting links 8, 8*a* and therefore their plates 21 may also have different geometries.

Figure 3:
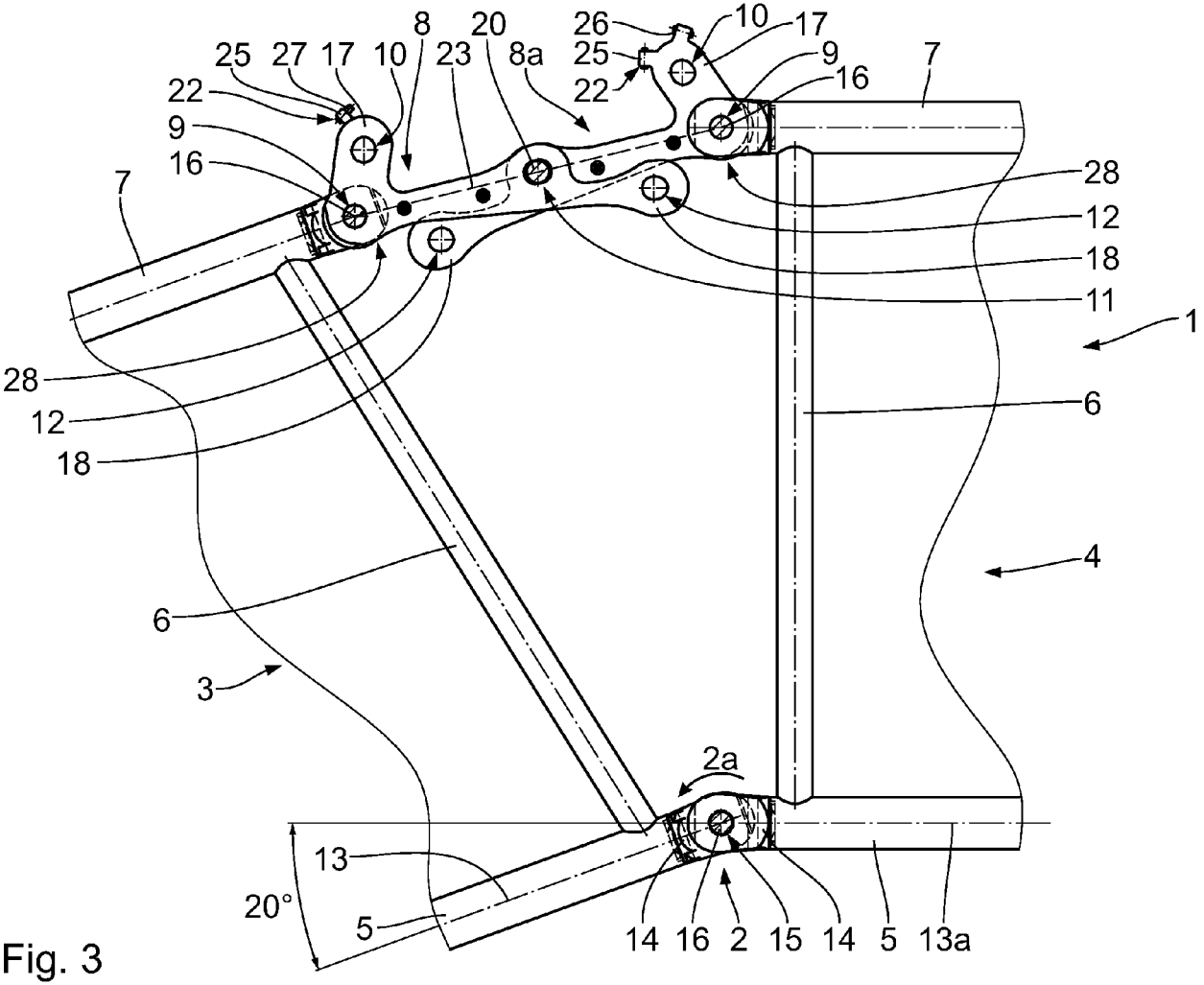
FIGS. 3 and 4 show side views of the jib system similar to FIG. 1, in two different target angle positions.
Figure 4:
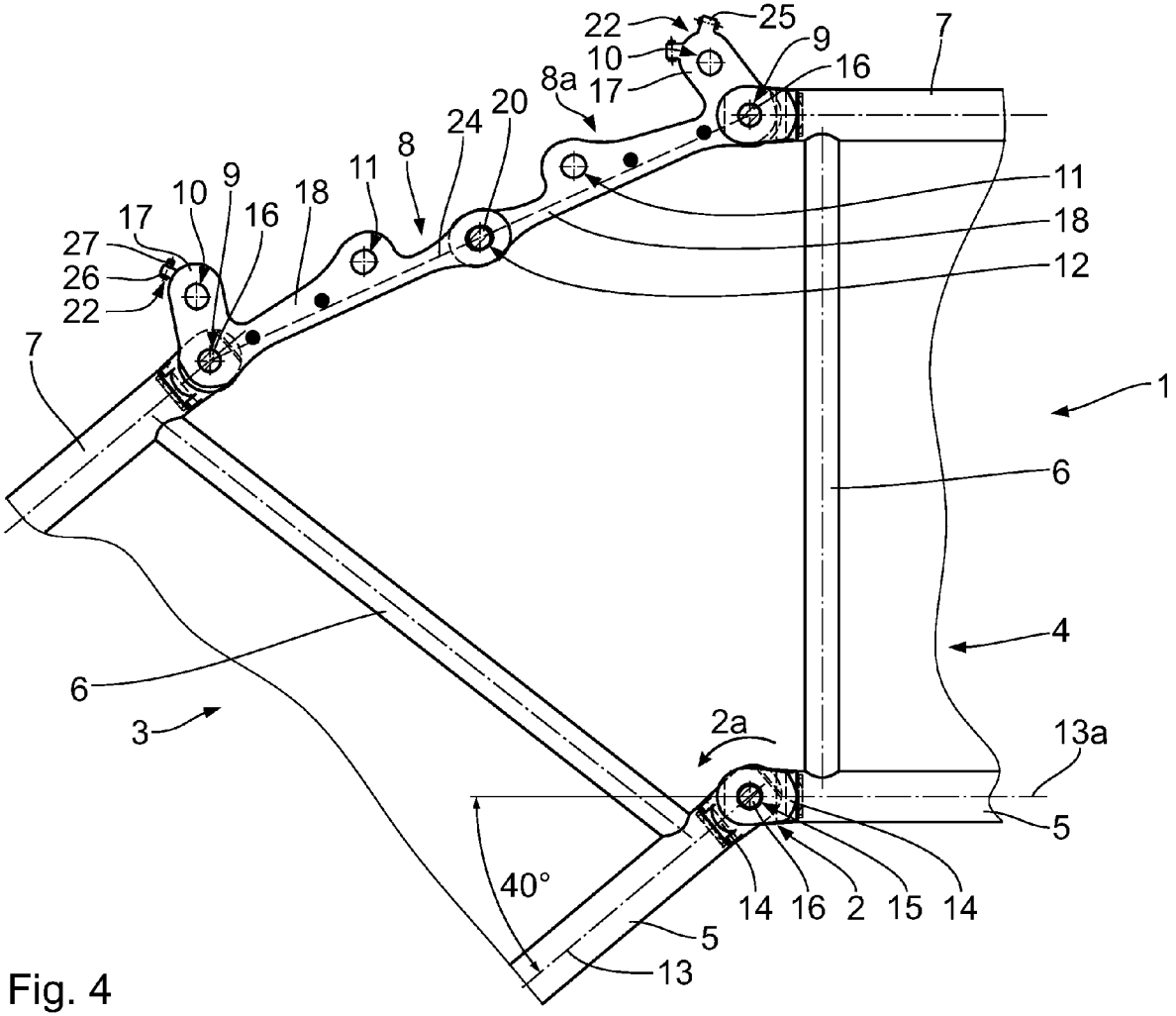

The jib system 1 is shown in FIG. 3 in a first target angle position and in FIG. 4 in a second target angle position. The first target angle position is distinguished in that the longitudinal axes 13, 13*a* of the jib units 3, 4 enclose an angle of 20°, and in the second target angle position, enclose an angle of 40°.

While in the 20° angle position, the connecting element 20 is arranged in the target openings 11, the connecting element 20 in the 40° angle position connects the target openings 12. In the 20° angle position, the vertex openings 9 and the target openings 11 connected to one another by the connecting element 20 are arranged on a straight line 23, and in the 40° angle position, the two vertex openings 9 and the target openings 12 connected to one another by means of the connecting element 20 are arranged on a straight line 24.

Figure 5:
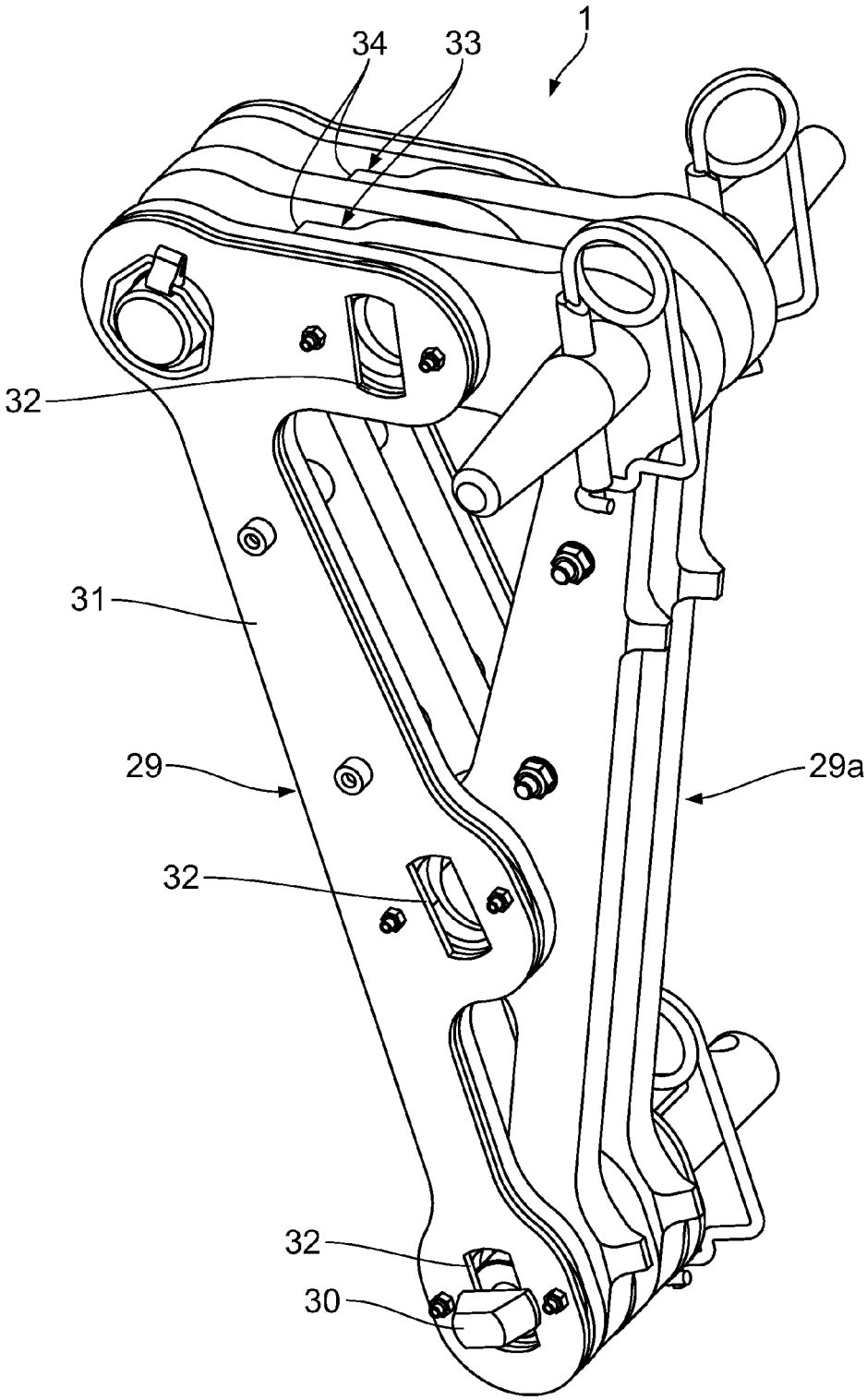
FIGS. 5 and 6 show perspective views of a second embodiment of connecting links of a jib system in a starting angle position and in a target angle position.
Figure 6:
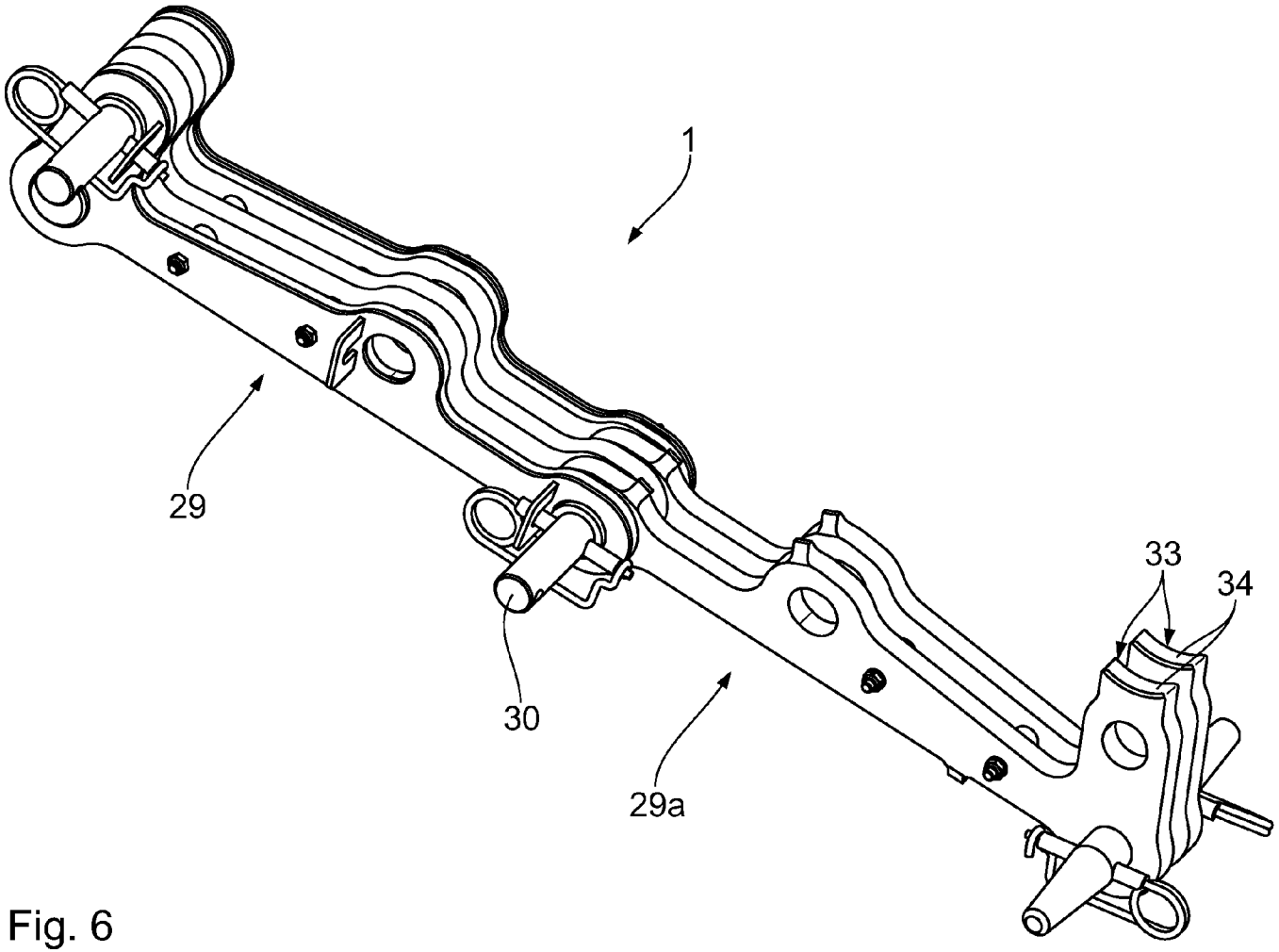

FIGS. 5 and 6 show a further embodiment of connecting links 29, 29*a* of the jib system 1. Components, which correspond to those which have already been described above with reference to FIG. 1 to 4, have the same reference numerals and are not discussed again in detail.

An important difference from the first embodiment of the jib system is the design of the connecting element as a bolt with a bayonet catch. For this purpose, a panel 31 is attached to one of the outer plates 21 of the connecting link 29, so the openings 10, 11, 12 are limited by a respective substantially rectangular cut-out 32. The bolt 30 is arranged in the target opening 12, the connecting links 29, 29*a* in FIG. 5 being shown in the starting angle position and in FIG. 6 in the 40° angle position.

The stop 33 is configured in this embodiment by rounded concave contact faces 34, which are provided on the first leg 17 of the connecting link 29*a*.

It is furthermore conceivable to use connecting links, in which, in each case, the angle arrangement of the legs is variable in relation to one another, for example in that a pivoting joint is provided on the vertex. Moreover, the legs, which are pivotably connected to one another, of a connecting link could have further target openings, which, in a varied angle arrangement of the legs in the starting angle position of the jib system, are aligned pairwise with one another, so further target angle positions of the connecting elements with only one connecting link are made possible. It is also possible to use connecting links, the angle arrangements of which differ between the legs. With these measures, the central spacings A1 to A3 between the aligned openings may be influenced in such a way that various angle positions can be adjusted.

What is claimed is:

1. A method for adjusting the angle of a jib system (1) of a crane, comprising:

firstly providing two jib units (3, 4) of the jib system (1), which can be variably arranged with respect to their longitudinal axes (13, 13*a*) in an angle position in relation to one another, secondly arranging connecting links (8, 8*a*; 29, 29*a*) attached to the jib units (3, 4) in a starting angle position in which the longitudinal axes (13, 13*a*) of the jib units (3, 4) are parallel, wherein the step of arranging comprises aligning starting openings (10), defined in respective ones of the connecting links, with one another pairwise to permit a connection element (20; 30) to be inserted into the aligned starting openings (10) connecting the jib unit (3,4), and wherein the step of arranging further comprises aligning target openings (11, 12) defined in respective ones of the connecting links (8, 8*a*; 29, 29*a*) with one another pairwise to permit the connecting element (20; 30) to be inserted into one of the aligned pairs of connecting links (8, 8*a*; 29, 29*a*) connecting the jib units (3, 4), and such that the aligned starting openings (10) are connected with the connecting element (20; 30), thirdly relieving the connecting element (20; 30) connecting the aligned starting openings (10) by lifting or supporting the jib unit (3), fourthly removing said connecting element (20; 30) from the aligned starting openings (10), fifthly connecting a pair of the aligned target openings (11; 12) with said connecting element (20; 30), and sixthly arranging the jib units (3, 4) in a target angle position which is different from the starting angle position.

2. A method according to claim 1, wherein the jib units (3, 4) are arranged in one of a group of a 20° position and a 40° position, by connecting a pair of the aligned target openings (11; 12).

3. A method according to claim 1, comprising adjusting the angle of the jib units (3, 4) by pivoting about a common pivoting unit (2).

4. A method according to claim 1, wherein it is possible to change the connecting element (20; 30) by hand.

5. A method according to claim 1, wherein the relieving of the connecting element (20; 30) takes place by lifting or supporting the jib unit (3) to be angled.

6. A method for adjusting the angle of a jib system (1) of a crane, comprising the steps:

firstly providing two jib units (3, 4) of the jib system (1), which can be variably arranged with respect to their longitudinal axes (13, 13*a*) in an angle position in relation to one another, secondly arranging connecting links (8, 8*a*; 29, 29*a*) attached to the jib units (3, 4) in a starting angle position, in said starting angle position the longitudinal axes (13, 13*a*) of the jib units (3, 4) are parallel in a starting angle position, wherein the step of arranging comprises aligning starting openings (10) with one another pairwise to permit a connecting element (20; 30) to be inserted into the aligned starting openings (10) connecting the jib unit (3, 4), and wherein the step of arranging further comprises aligning target openings (11, 12) of the connecting links (8, 8*a*; 29, 29*a*) with one another pairwise to permit the connecting element (20; 30) to be inserted into one of the aligned pairs of connecting links (8, 8*a*; 29, 29*a*) connecting the jib units (3, 4), and such that the aligned starting openings (10) are connected with the connecting element (20; 30), thirdly relieving the connecting element (20; 30) connecting the aligned starting openings (10) by lifting or supporting the jib unit (3), fourthly removing said connecting element (20; 30) from the aligned starting openings (10), fifthly connecting a pair of the aligned target openings (11; 12) with said connecting element (20; 30), sixthly arranging the jib units (3, 4) in a target angle position which is different from the starting angle position, and wherein the jib units (3, 4) are arranged in one of two possible target angle positions, by connecting one of the pairs of the aligned target openings (11; 12).

* * * * *